US012507842B2

(12) United States Patent
Bendahan et al.

(10) Patent No.: US 12,507,842 B2
(45) Date of Patent: Dec. 30, 2025

(54) TOILET

(71) Applicant: AERSTOP Oy, Pori (FI)

(72) Inventors: Michel Bendahan, la Tessoualle (FR); Jean Louchet, Vannes-sur-Cosson (FR)

(73) Assignee: AERSTOP Oy, Pori (FI)

( * ) Notice: Subject to any disclaimer, the term of this patent is extended or adjusted under 35 U.S.C. 154(b) by 344 days.

(21) Appl. No.: 18/172,911

(22) Filed: Feb. 22, 2023

(65) Prior Publication Data

US 2024/0277192 A1 Aug. 22, 2024

(51) Int. Cl.

| | |
|---|---|
| ***E03D 9/05*** | (2006.01) |
| ***A47K 13/24*** | (2006.01) |
| ***A47K 13/30*** | (2006.01) |

(52) U.S. Cl.

CPC ..... *A47K 13/242* (2013.01); *A47K 13/302* (2013.01); *E03D 9/05* (2013.01)

(58) Field of Classification Search

CPC .. A47K 13/307; A47K 13/302; A47K 13/305; E03D 9/05; E03D 9/04; E03D 9/052

See application file for complete search history.

(56) References Cited

U.S. PATENT DOCUMENTS

| | | | | |
|---|---|---|---|---|
| 3,266,060 | A | 8/1966 | Springer | |
| 4,094,023 | A | 6/1978 | Smith | |
| 4,933,995 | A * | 6/1990 | Canon | E03D 9/04 4/209 R |
| 9,808,132 | B2 | 11/2017 | Smith | |
| 11,993,926 | B2 * | 5/2024 | Beneda | B01D 46/0028 |
| 2005/0138721 | A1 | 6/2005 | Bowman et al. | |
| 2010/0281608 | A1 | 11/2010 | Alexander | |
| 2016/0312454 | A1 | 10/2016 | Mantel et al. | |
| 2020/0245828 | A1 * | 8/2020 | Bahn | F16J 15/027 |
| 2022/0408988 | A1 * | 12/2022 | Baines | E03D 9/002 |

FOREIGN PATENT DOCUMENTS

| | | | |
|---|---|---|---|
| CA | 2347273 | C | 7/2004 |
| CN | 11137391 | A | 6/2020 |
| EP | 0223764 | A2 | 5/1987 |
| EP | 4074905 | A1 | 10/2022 |
| GB | 2143872 | A | 2/1985 |
| GB | 2256206 | A | 12/1992 |
| GB | 2384009 | A | 7/2003 |
| GB | 2442727 | A | 4/2008 |
| KR | 102257794 | B1 * | 5/2021 |
| WO | WO0013565 | A1 | 3/2000 |
| WO | WO2015089722 | A1 | 6/2015 |

OTHER PUBLICATIONS

Notification dated Nov. 6, 2024 for European Application No. 22168038.2-1005.

* cited by examiner

*Primary Examiner* — Erin Deery

(57) ABSTRACT

A toilet comprises a bowl having an interior volume, a toilet seat, mounted to move relative to the bowl between a raised position and a lowered position, a seal disposed between the bowl and the toilet seat in the lowered position, and in contact with the toilet seat and the bowl to form a seal between the toilet seat and the bowl, a non-return valve adapted to allow a passage of ambient air towards the interior volume, and to prevent a passage of air from the interior volume towards the outside.

11 Claims, 3 Drawing Sheets

TOILET

FIELD OF THE INVENTION

The present invention relates to a toilet.

TECHNOLOGICAL BACKGROUND

Conventional toilets have a simple evacuation system consisting of a flush. When the flush is activated, a large quantity of water is supplied, creating turbulence and therefore a large aerosol; Further, the momentary rise in the level of liquid in the bowl tends to propel outwardly the aerosols created by the evacuation turbulences, which are located immediately above the bowl.

The aerosols produced in toilet bowls during their use or the action of the flush, in addition to their inconvenience (odors), are likely to contain and spread pathogenic microorganisms, in particular those present in stools. In residential buildings, as well as in professional premises and communities, toilets are often a major source of airborne contamination.

Mechanical Vacuum Systems

Mechanical vacuum systems are primarily intended to remove or reduce odors. A grinder toilet is known, combining a conventional flush with a suction and grinding system located downstream, intended for installations that do not allow a diameter of the evacuation pipes sufficient for a conventional toilet. In terms of turbulence and aerosols, they do not provide a decisive advantage over conventional toilets.

Other systems, related to grinder toilets, implement mechanical suction of the materials in addition to the siphoning effect: let us quote for example the European patent application EP 0 223 764.

These techniques have little effect on aerosol production or dispersion.

Sealing

U.S. Pat. No. 3,266,060 describes a toilet comprising a bowl and a toilet seat with, on its underside, a protrusion which is said to form a barrier both airtight and watertight between the toilet seat and the bowl.

This document also describes a mechanism for triggering the flush when the cover is closed.

This patent also describes an anti-odor mechanism, which includes a fan that guides the air from the bowl to an exhaust channel. Raising the cover starts the fan.

Ultraviolet (UV) Radiation Disinfection

Document WO 00/13,565 describes a toilet seat whose underside is fitted with a UV tube which can be electrically powered to emit radiation with a wavelength of between 250 and 270 nm with a view to emitting radiation of the order of 30 mW/cm$^2$. Actuation for a period of between 15 seconds and 15 minutes may be sufficient to obtain the desired decontamination effect. It is better to control the system so that the radiation is triggered with the cover closed, which can be done either by a sensor or by automating the closing.

The document also provides for a metal reflector to direct UV radiation in the right direction. There is no mention of waterproofing.

Finally, it is mentioned there that prior to this invention, a toilet from the CWS company implemented systematic disinfection with an antibacterial agent after each flush.

Vacuum Ring

Document GB 2 384 009 describes a sanitary toilet seat whose inner face is provided with a "vacuum ring". The vacuum ring is put under vacuum by a pump, which makes it possible to suck up the stale air present in the bowl.

The underside of the toilet seat may also include a switch that will activate the system when someone sits on it.

As a variant, the ring can be placed on the upper surface of the bowl, at the interface with the toilet seat.

Detergent

Document GB 2 442 727 describes a toilet which can be sealed in order to be decontaminated by a detergent.

The actuation of the detergent can be done after an automatic closing of the bowl, or following a detection that the bowl is properly closed, to prevent detergent from escaping outside the bowl.

Nozzles are arranged in the cover so as to emit the detergent into the closed toilet.

Double Seal

Document US 2010/281,608 describes a toilet with a seal between the bowl and the toilet seat, and a seal between the toilet seat and the cover, so as to close the toilet in an airtight manner.

However, the intended purpose of this seal is to suck in, via a duct extending between an end opening into the bowl above the water level, and a discharge pipe, the stale air present in the space above the water level inside the bowl.

Ozone

US 2016/312,454 was published on Oct. 27, 2016. It describes several embodiments.

According to a first embodiment, an actuation button will trigger the operation of irradiation devices located outside, which will generate UV-C radiation with a view to generating ozone, and a fan will blow the ozone-laden air in the toilet bowl in order to decontaminate it. The system can work 5 to 10 minutes after actuation. The cover must be closed during disinfection, and a sensor can be used to detect this closure.

As a variant, an automatic closing system can be envisaged.

According to a second embodiment, the irradiation device and the fan are replaced by a reservoir full of overpressure ozone, the opening of which is triggered at the appropriate time, so that the ozone reaches the bowl.

There is no mention of a seal between the cover and the bowl, only of a closure of the cover.

High Tension

Document CN111317391 essentially describes a system for deactivating viruses and microorganisms present in the toilet bowl, and capable of forming aerosols. This treatment is carried out by the application of a high voltage. More precisely, the high voltage will ionize the oxygen present in the air, and this ionized oxygen would have a biocidal effect.

The document insists on the tightness between the components. A seal is provided between the cover body and the upper surface of the bowl. The seal has the effect of preventing the spread of the virus outside the toilet. The document also mentions the automation of the steps of closing the cover, triggering the high voltage, and flushing, by means of a controller.

The present invention relates to a system for preventing and protecting against aerosols from the toilet bowl, likely to carry pathogenic germs.

SUMMARY OF THE INVENTION

Thus, the invention relates to a toilet comprising:

- a bowl having an interior volume,
- a toilet seat, mounted to move relative to the bowl between a raised position and a lowered position, a seal disposed between the bowl and the toilet seat in the lowered position, and in contact with the toilet seat and the bowl to form a seal between the toilet seat and the bowl, a suction system adapted to suck air from the interior volume, an actuation system of the suction system adapted to trigger the suction system according to the position of the toilet seat.

Thanks to these arrangements, the diffusion of aerosols outside the bowl is limited. In particular, according to a particular case, if the toilet seat is in the raised position, the triggering of the suction system is prohibited.

According to various aspects, it is possible to provide one and/or the other of the characteristics below taken alone or in combination.

According to one embodiment, the toilet further comprises a cover, and a seal disposed between the toilet seat and the cover in the lowered position of the cover, and in contact with the toilet seat and the cover to form a seal between the toilet seat and the cover.

According to one embodiment, the toilet comprises a drain water tank controlled to alternately release drain water or retain it.

According to one embodiment, the suction system is controlled to draw air from the interior volume in addition during the release of the evacuation water.

According to one embodiment, the actuation command of the water tank or the release of the evacuation water is adapted to trigger the actuation system of the suction system.

According to one embodiment, the toilet comprises a drain water tank controlled to alternately release drain water or retain it, and detection of the lowered position of the cover authorizes the release of the actuation control of the water tank or triggers the release of water contained in the water tank.

According to one embodiment, the toilet further comprises a non-return valve adapted to allow ambient air to pass to the interior volume, and to prevent air from passing from the interior volume to the exterior.

According to one embodiment, the suction system is controlled by a depression sensor adapted to determine that the interior volume is under depression.

According to one embodiment, the toilet further comprises a system for locking the cover in the lowered position, adapted to pass from an active configuration in which it prevents the cover from passing from the lowered position to a raised position to a passive configuration in which it allows the cover to pass from the lowered position to a raised position.

According to one embodiment, the passage of the locking system from the active configuration to the passive configuration, or the authorization of this passage is controlled by a depression sensor adapted to determine that the interior volume is under depression.

According to one embodiment, the toilet comprises a UV radiation system adapted to be controlled to implement physical decontamination of the interior volume, and/or a chemical decontamination system adapted to be controlled to implement chemical decontamination of the volume interior.

According to one embodiment, the toilet comprises a locking system of the cover in the lowered position, suitable for passing from an active configuration in which it prevents the passage of the cover from the lowered position to a raised position to a passive configuration in which it allows the cover to pass from the lowered position to a raised position, and a UV radiation system adapted to be controlled to implement physical decontamination of the interior volume, and/or a chemical decontamination system adapted to be ordered to implement a chemical decontamination of the interior volume, and the locking system is prohibited from changing from its active configuration to its passive configuration when the UV radiation system and/or the chemical decontamination system is functional.

According to one embodiment, the toilet comprises a UV radiation system adapted to be controlled to implement physical decontamination of the interior volume, and/or a chemical decontamination system adapted to be ordered to implement a chemical decontamination of the interior volume, and the activation of the UV radiation system and/or of the chemical decontamination system is controlled by a depression sensor adapted to determine that the interior volume is under depression.

According to one aspect, the invention relates to a toilet seat, a cover, or a toilet seat/cover assembly of such toilet.

According to another aspect, the invention relates to a toilet which comprises:

a bowl having an interior volume, a toilet seat, mounted to move relative to the bowl between a raised position and a lowered position, a seal disposed between the bowl and the toilet seat in the lowered position, and in contact with the toilet seat and the bowl to form a seal between the toilet seat and the bowl, a non-return valve adapted to allow a passage of ambient air towards the interior volume, and to prevent a passage of air from the interior volume towards the outside.

According to one embodiment, the toilet further comprises a suction system adapted to suck air from the interior volume and an actuation system of the suction system adapted to trigger the suction system according to the position of the toilet seat.

According to one embodiment, the toilet further comprises a cover, and a seal disposed between the toilet seat and the cover in the lowered position of the cover, and in contact with the toilet seat and the cover to form a seal between the toilet seat and the cover.

According to one embodiment, the toilet further comprises a locking system of the cover in the lowered position, suitable for passing from an active configuration in which it prevents the passage of the cover from the lowered position to a raised position to a passive configuration in which it allows the cover to pass from the lowered position to a raised position.

According to one embodiment, the passage of the locking system from the active configuration to the passive configuration, or the authorization of this passage is controlled by a depression sensor adapted to determine that the interior volume is under depression.

According to one embodiment, the toilet comprises a UV radiation system adapted to be controlled to implement physical decontamination of the interior volume, and/or a chemical decontamination system adapted to be ordered to implement a chemical decontamination of the interior volume.

According to one embodiment, the toilet further comprises a locking system of the cover in the lowered position, suitable for passing from an active configuration in which it prevents the passage of the cover from the lowered position to a raised position to a passive configuration in which it allows the cover to pass from the lowered position to a raised position, a UV radiation system adapted to be controlled to implement physical decontamination of the interior volume, and/or a chemical decontamination system adapted to be ordered to implement a chemical decontamination of the interior volume, and the locking system is prohibited from passing from its active configuration to its passive configuration when the UV radiation system and/or the chemical decontamination is functional.

According to one embodiment, the activation of the UV radiation system and/or of the chemical decontamination system is controlled by a depression sensor adapted to determine that the interior volume is under depression.

According to one embodiment, the toilet comprises a drain water tank controlled to alternately release drain water or retain it.

According to one embodiment, the toilet comprises a drain water tank controlled to alternately release drain water or retain it, and wherein the suction system is controlled to draw air from the interior volume additionally during the release of the drain water.

According to one embodiment, the actuation control of the water tank or the release of the waste water is adapted to trigger the actuation system of the suction system.

According to one embodiment, the toilet comprises a drain water tank controlled to alternately release drain water or retain it, and in which the detection of the lowered position of the cover authorizes the release of the control for actuating the water tank or triggers the release of water contained in the water tank.

BRIEF DESCRIPTION OF DRAWINGS

Embodiments of the invention will be described below with reference to the drawings, briefly described below.

Figure 1:
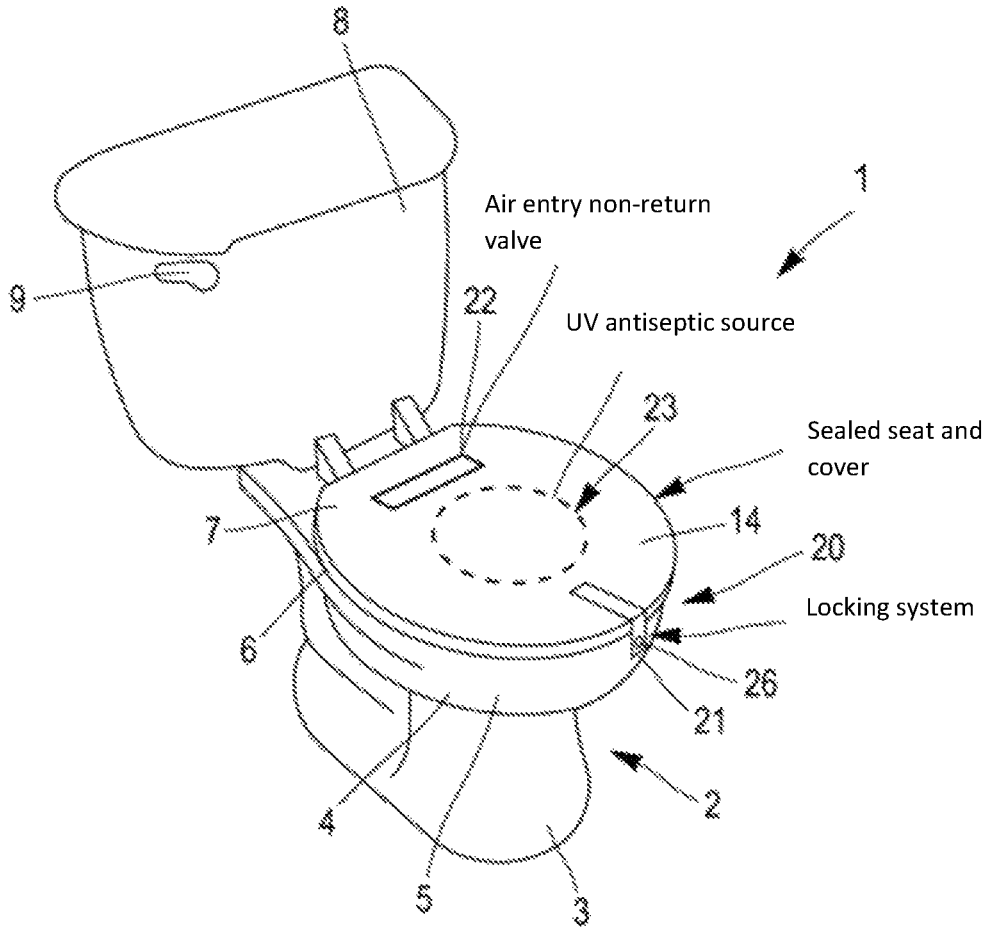
FIG. 1 shows in perspective a toilet according to one embodiment of the invention.

In the drawings, identical references designate identical or similar objects.

DETAILED DESCRIPTION

The object of the present invention is to reduce the production and dispersion of aerosols during use, then at the time of the action of the flush and after the evacuation of the toilet. It is intended primarily to limit the airborne transmission of SARS-CoV-2, but is directly transposable to any other airborne pathogen.

FIG. 1 schematically shows a toilet 1 that can be used for the implementation of the invention. Toilet 1 includes a bowl 2. The bowl 2 is for example borne by a footage 3 placed on the ground and fixed thereto. Alternatively, the toilet could be attached to the back wall. The bowl 2 comprises an outer wall 4 defining a hollow interior volume capable of receiving, in normal use, a liquid. The bowl 2 comprises an upper opening (not visible in FIG. 1, because it is closed by the toilet seat and the cover which will be described below), allowing access to the hollow interior volume.

The bowl 2 also includes a drain allowing the liquid present in the bowl to be evacuated.

The outer wall 4 comprises an inner face facing the inner volume, and an opposite outer face 5. According to the shown embodiment, the outer face 5 has a flared shape upwards.

Figure 2:
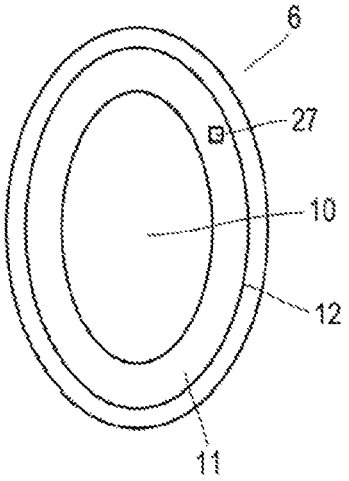
FIG. 2 shows a toilet seat of the toilet of FIG. 1 in bottom view.

The toilet 1 also includes a toilet seat 6. The toilet seat 6 comprises a fine annular plate provided with a central opening 10, visible in FIG. 2. The annular plate has a lower face 11 and an opposite upper face. According to one embodiment, as shown in FIG. 2, the toilet seat 6 includes a seal 12. The seal 12 is placed on the underside 11. It is continuous and defines a closed geometric pattern. In particular, it surrounds the central opening 10. It is made of a suitable material, for example elastomer.

The toilet seat 6 is mounted to move relative to the bowl 2 between a lowered configuration and a raised configuration. The mobility is for example a pivoting relative to a horizontal axis situated at the rear of the upper face of the bowl. In the lowered configuration, the toilet seat 6 rests on the bowl, with the central opening in communication with the hollow interior volume. The underside of the toilet seat 6 and the seal 12 rest against the upper side of the bowl 2. The upper face of the toilet seat 6 faces upwards.

In the raised configuration, the toilet seat 6 extends with its lower face remote from the upper face of the bowl 2, for example vertically.

Figure 3:
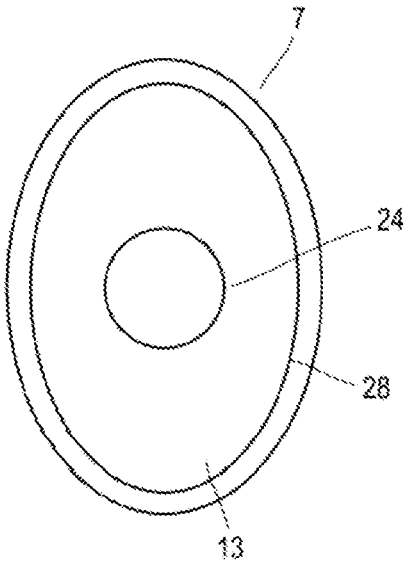
FIG. 3 shows a toilet cover of FIG. 1 in bottom view.

The toilet 1 also includes a cover 7. The cover 7 comprises a solid thin annular plate. The annular plate has a lower face 13 and an opposite upper face 14. According to one embodiment, as shown in FIG. 3, the cover 7 includes a seal 28. The seal 28 is placed on the underside 11. It is continuous and defines a closed geometric pattern. In particular, it is arranged so as to face the upper face of the toilet seat 6, as will be described in detail below. It is made of a suitable material, for example elastomer.

The cover 7 is mounted to move relative to the bowl 2 between a lowered configuration and a raised configuration. The mobility is for example a pivoting relative to a horizontal axis situated at the rear of the upper face of the bowl. If applicable, it is the same pivot axis as that of toilet seat 6. The toilet seat 6 is arranged between the cover 7 and the bowl 2. In the lowered configuration, the cover 7 rests on the toilet seat 6, so as to block the central opening. The underside of the cover 7 and the seal 28 rest against the upper side of the toilet seat 6. The upper side of the cover faces upwards.

In the raised configuration, the cover 7 extends with its lower face remote from the upper face of the bowl 2. In the raised configuration, the cover 7 allows mobility of the toilet seat 6 between its own lowered and raised configurations. In the raised configuration of the toilet seat 6 and cover 7, the upper face of toilet seat 6 can be in contact with the lower face of the cover 7.

The toilet 1 also includes a water tank 8 in fluid communication with the bowl 2. In particular, the water tank 8 opens into the bowl above the level of water 15 contained therein. The toilet 1 includes a control 9 for triggering the flow of water contained in the water tank 8 towards the bowl 2. The water tank 8 is for its part hydraulically connected to a water supply, so as to be filled after having been emptied.

Figure 4:
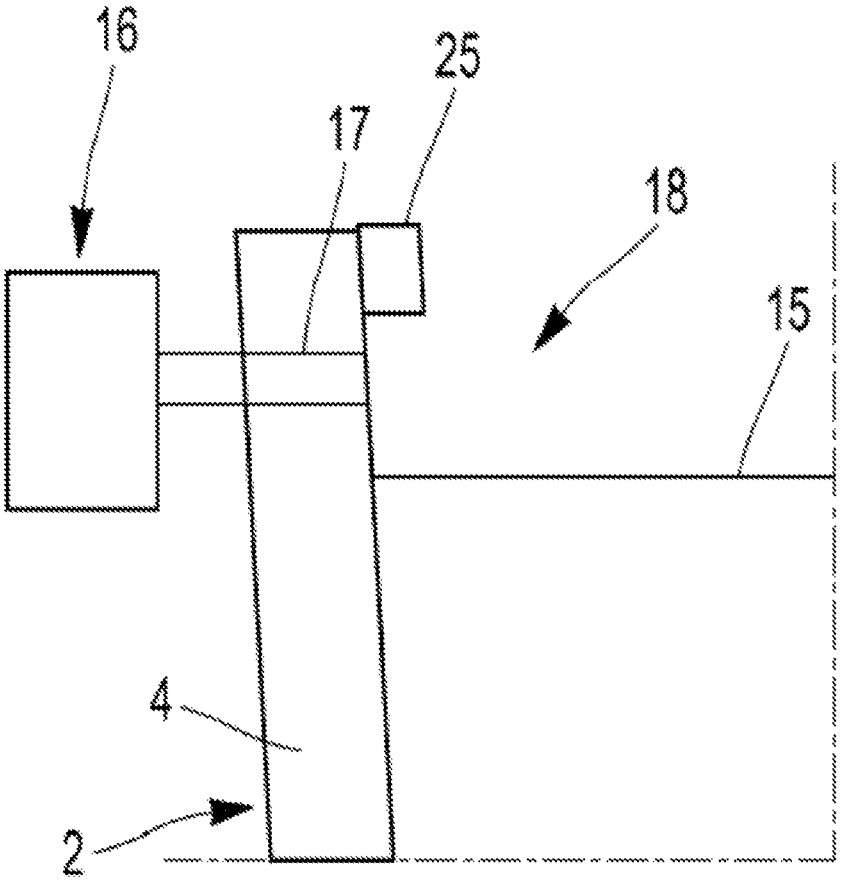
FIG. 4 shows a sectional side view of part of the toilet bowl of FIG. 1.

As shown in FIG. 4, according to one embodiment, the toilet 1 comprises a suction system 16 of the fluids of the bowl 2 above the water level. The suction system 16 comprises for example a pipe 17 passing through the outer wall 4, between one end opening into the interior volume 18 above the water level 15, and a second end (not shown) outside. The suction system 16 also comprises a pump 19 or other system adapted to suck from the interior volume 18 via the pipe 17.

As shown in FIG. 1, according to one embodiment, the toilet 1 may include a system for locking the toilet seat and/or the cover in the lowered configuration. The example presented in particular comprises a system for locking the cover in the lowered configuration, whereby the toilet seat placed between the bowl and the cover is also blocked. The locking system 20 is a reversible locking system. According to an exemplary embodiment, the locking system 20 can be a clipping system. However, other reversible locking technologies are possible. The clipping system takes advantage of the flared shape at the top of the bowl. Thus, the clipping system may comprise an arm 21 which is elastically deformable, and carried by the cover 7. When the cover 7 is moved from its raised configuration to its lowered configuration, the protuberance of the bowl causes the elastic deformation of the arm 21 outside its position of equilibrium. Once the cover is in the lowered configuration, the arm 21 exerts an elastic stress on the bowl 2, which retains the cover in the locked position. If the cover is moved from its lowered configuration to its raised configuration, this elastically deforms the arm 21, so that the latter disengages from the bowl.

FIG. 1 shows an arm 21 arranged at the front of the cover 7. However, the number, position and configuration of the arms may vary.

As a variant, the locking system may comprise a rigid or semi-rigid hoop or a system of rotating or sliding locks combined with a clamping device, either in a strap and a hooking system, making it possible to secure the tank, the toilet seat and the cover.

According to one embodiment, the toilet 1 also comprises a non-return valve 22 adapted to, in the lowered configuration of the cover 7, allow the passage of ambient air from outside the toilet to the interior volume 18, but prevent a passage of gas in the opposite direction. In the embodiment of FIG. 1, the non-return valve 22 is arranged on the cover 7, and passes through the thin plate constituting the cover 7. However, as a variant, the non-return valve 22 could be arranged elsewhere, in particular in the bowl 2 above the water level 15.

According to one embodiment, the toilet 1 also includes an ultraviolet radiation system 23. The toilet 1 comprises in particular a lamp 24 emitting ultraviolet radiation, capable of emitting radiation into the interior volume 18. In the example shown, the lamp 24 is arranged on the lower face 13 of the cover 7. Ultraviolet radiation system 23 also includes an electrical power supply system supplying energy to the lamp 24.

According to one embodiment, the toilet 1 may comprise a chemical disinfection system 25 suitable for dispensing disinfectant antiseptic chemicals 25 into the interior volume 18. The chemical disinfection system 25 may for example comprise a nozzle opening into the interior volume 18, and adapted to dispense a disinfectant chemical product contained in a reservoir (not shown).

According to an exemplary embodiment, the system which has just been described can be controlled by a controller.

For example, the water tank 8 is connected to the controller, so that the controller receives information relating to the filling level of the water tank 8.

For example, the command 9 of the water tank 8 can be connected to the controller, so that the controller receives information relating to the actuation of the command 9.

The suction system 16 can be connected to the controller so as to receive a command to trigger the suction system. The controller can generate this command for example according to information relating to the level of the water tank and/or relating to the actuation of the command. The command may include a time delay, that is to say a start of triggering of the suction system after a predetermined duration after the generating event and/or for a predetermined duration depending on the generating event.

For example, a sensor 26 is used to determine that the interior volume 18 is hermetically sealed. This sensor 26 is for example part of the locking system 20, and detects that the locking system 20 is in the locked configuration. According to an alternative embodiment, the sensor 26 detects a horizontal position of the cover 7. Other realizations are possible. The sensor 26 is connected to the controller, so that the controller receives information relating to the closure of the interior volume 18.

The water tank 8 or the command 9 can be connected to the controller so as to receive a command to trigger the water tank. The controller can generate this command for example based on information relating to the closure of the interior volume 18. For example, if the interior volume 18 is not closed, a blocking system prevents the control 9 from being actuated, this blocking system being released by the detection of the closure of the interior volume 18.

Where appropriate, the toilet 1 does not include an external command for draining the water tank, but an internal command, not accessible to a user, and controlled by the controller.

For example, a component can be connected to the controller so that the controller receives information relating to the conditions prevailing in the interior volume. It may for example be a pressure sensor, suitable for measuring an ambient pressure of the gases present in the interior volume. The pressure sensor is for example fixed to the bowl 2 or to the inner face of the cover 7. As a variant or in addition, it is possible to use a sensor of the non-return valve 22 detecting a closing of the non-return valve.

The chemical disinfection system 25 can be connected to the controller so as to receive a command to trigger the chemical disinfection system 25. The controller can generate this command for example according to information relating to the conditions in the interior volume 18. For example, if the interior volume 18 is under depression, or the non-return valve is open, the controller commands the chemical disinfection system 25 to dispense disinfectant chemical.

As a variant, the chemical disinfection system can be sealed off by a sealing system sensitive to the surrounding pressure, so that at atmospheric pressure, or at a higher pressure, the system is sealed off and, in the event of a depression, the system is open, allowing the dispensing of a disinfection fluid.

Alternatively, the disinfection chemical system 25 can deliver the disinfection fluid to the water tank 8.

The UV radiation system 23 can be connected to the controller so as to receive a command to trigger the UV radiation system. The controller can generate this command for example according to information relating to the conditions in the interior volume 18. For example, if the interior volume 18 is under depression, or the non-return valve is open, the controller commands the UV radiation system 23 to dispense disinfectant chemical.

According to one embodiment, the toilet 1 can be prevented from being used during the action of the UV radiation system 23 or of the chemical disinfection system 25.

For example, if the toilet is located in a closed room, the controller can be connected to the door lock to prevent the unlocking of the lock from the outside if the UV radiation system 23 and/or the chemical disinfection system 25 are working. This system is to be coupled with a presence detector which confirms the absence of anyone in the room before locking the door and controlling the triggering of the UV radiation system 23 and/or the chemical disinfection system 25.

Alternatively, the locking system 20 is controlled by the controller. The controller sends a command to release the locking system 20 after the action of the UV radiation system 23 and/or the chemical disinfection system 25. The end of this action can be determined by means of a time delay from the instant of emission of the command for actuating the UV radiation system 23 and/or the chemical disinfection system 25, or by a detection that the system is no longer active by means of a dedicated sensor.

For example, a sensor 27 is used to determine that the toilet is being used by a user seated on the toilet seat. This sensor 27 is for example arranged on the lower face 11 of the toilet seat 6 in contact with the upper face of the bowl, and detects a mass greater than the combined masses of the toilet seat 6 and of the cover 7. The sensor 27 is connected to the controller, so that the controller receives information relating to the occupation of the toilet seat 6.

The suction system 16 can be connected to the controller so as to receive a command to trigger the suction system 16. The controller can generate this command for example according to information relating to the occupation of the toilet seat 6. For example, if the toilet seat 6 is occupied, the controller triggers the actuation of the suction system 16.

The various sensors and systems, as well as the controller described above are supplied with energy, and connected together so as to be able to exchange information and commands.

Alternatively, if desired, a mechanism can be used instead of a controller to control a chain of reaction from an event to an action that results from it.

The actual human use of the toilet (seated user) makes it difficult to ensure its tightness. The diffusion of aerosols created by this operation should be limited.

In an initial configuration, the toilet 1 is available for use. The water tank 8 is full. The UV radiation 23 and chemical disinfection 25 systems are not operational. The cover 7 is raised, and the toilet seat 6 is lowered. If the cover 7 and the toilet seat 6 are not in this configuration, nothing prevents the user from placing them there.

If the user sits on the toilet seat 6, the sensor 27 detects this presence, and sends the information to the controller which triggers the suction system 16. The suction system 16 then sucks the air from the interior volume.

Once the user releases the toilet seat, the suction system 16 continues to operate due to a time delay.

The user is then prevented from operating the control 9 of the water tank 8.

The user lowers the cover 7 on the toilet seat 6, and the locking system 20 switches to the locked configuration. If necessary, a mechanism moves the cover 7 in the lowered configuration. The seals 12 and 28 are then compressed. The suction continues through the non-return valve 22 which allows the entry of ambient air into the interior volume. The detection of the lowered configuration and/or of the locked state of the locking system 20 by the controller authorizes the release of the command 9 for actuating the water tank 8 or, alternatively triggers the release of the water contained in the water tank 8. This implies that this control or water release is prohibited with the cover up or the locking system 20 unlocked.

After this use, once the seat and the cover have been closed, the action of the flush first causes an overpressure of air, followed by a depression at the time of siphoning.

During the overpressure phase, the air cannot escape from the bowl to the outside.

This is ensured by the seals and the suction system 16.

During the next phase of depression (siphoning), a tight closure of the bowl would impede the flow. The non-return valve allows outside air to enter the bowl but prevents it from leaving.

Once the evacuation has been carried out, residual aerosols may remain in the bowl and can then be neutralized by the use of ultraviolet radiation and/or chemical products. The disinfection chemical system 25 and/or the UV radiation system 23 are triggered by the appropriate detection, as shown above.

Finally, the cover is unlocked for later use. The depression sensor, which detects that the interior volume is no longer under depression, authorizes the unlocking of the cover locking system.

Thus, according to a first case, the controller receives information relating to the position of the toilet seat and information from the depression sensor, and deactivates the unlocking system on the basis of these two pieces of information.

According to a variant, the controller receives information from the depression sensor, and deactivates the unlocking system based on this information. Indeed, the depression sensor can only detect the end of the depression phenomenon with the cover closed, and therefore the toilet seat also closed.

According to a variant embodiment, the scenario presented above is reproduced, except that the actuation of the suction system is not triggered by the detection of the occupation of the toilet seat. According to this variant, the actuation of the suction system is triggered either by the lowering of the cover, or by the passage of the locking system in the locked position, or by the actuation command of the water tank, or by the detection of the release of water from the water tank, or by the detection of a predetermined variation in pressure inside the bowl resulting from the release of water, each of these alternatives being authorized only with the toilet seat down.

Thus, according to a first case, the controller receives information relating to the position of the toilet seat and information relating to the release of the evacuation water, and triggers the suction system on the basis of these two pieces of information.

According to a variant, the controller receives information relating to the release of the evacuation water, and triggers the suction system based on this information. This alternative embodiment can be implemented if the actuation of the release of the evacuation water is only authorized with the cover down, and therefore with the toilet seat down.

The device that is the subject of this patent aims both to prevent the diffusion of odors and aerosols liable to be vectors of pathogenic germs.

For this, the invention uses several means, separately or in combination:

1. Limit the diffusion of aerosols during human use of the WC, by supplementing the seal placed under the toilet seat with a device for extracting ambient air from the bowl;
2. Limit the diffusion of aerosols during the first phase of the action of the flush (when the bowl is under overpressure) by completing the seals located under the seat and under the cover, with a suction device, which has been implemented during the use of the WC, but if necessary here with a different and adapted power. This suction system may or may not make use of a "vacuum reserve", a vacuum reservoir opening at the time of overpressure in the bowl;

3. In order not to disturb the appropriate flow and siphoning, provide either the seat, or the cover, or the toilet bowl itself, with a non-return valve allowing the suction of ambient air through the bowl, but not a flow in the opposite direction; this may or may not be combined with a suction device as mentioned above;
4. a device making it possible to actuate the flush, or ensuring the triggering of the flush, only once the toilet seat and the cover have been correctly closed and ensuring the seal;
5. a device for locking the cover and the toilet seat on the bowl, by mechanical or hydraulic process, so as to prevent any air escaping from the bowl due to a possible overpressure during the action of the flush;
6. a chemical disinfection device, consisting of the automatic addition of an antiseptic to the flushing liquid or to the bowl, by a system automatically actuated by the detection of depression given by the position of the valve or the non-return valve;
7. a physical disinfection device, consisting of the activation of a source of UV radiation for a limited time, inside the bowl, initiated by the detection of depression in the bowl signaled by a sensor or switch integrated in the valve anti-reverse;
8. the blocking of the use of the WC as long as the chemical or physical disinfection operation linked to the two points above has not been completed.

LIST OF REFERENCE SIGNS

1: Toilet
2: Bowl
3: Footage
4: Outer wall
5: Outer side
6: Toilet seat
7: Cover
8: Water tank
9: control
10: Central opening
11: Lower side
12: Seal
13: lower side
14: upper side
15: Water level
16: Suction system
17: Pipe
18: Interior volume
19: Pump
20: Lock system
21: Arm
22: Check valve
23: UV radiation system
24: Lamp
25: Chemical disinfection system
26: Sensor
27: Sensor
28: Seal

The invention claimed is:

1. A toilet, wherein the toilet comprises:

a bowl having an interior volume, a toilet seat, mounted to move relative to the bowl between a raised position and a lowered position, a first continuous seal defining a closed geometric pattern, disposed between the bowl and the toilet seat in the lowered position, and in contact with the toilet seat and the bowl to form a seal between the toilet seat and the bowl, a non-return valve adapted to allow a passage of ambient air towards the interior volume, and to prevent a passage of air from the interior volume towards the outside, a cover, a second continuous seal defining a closed geometric pattern, disposed between the toilet seat and the cover in a lowered position of the cover, and in contact with the toilet seat and the cover to form a seal between the toilet seat and the cover, and a UV radiation system adapted to be controlled to implement physical decontamination of the interior volume.

2. The toilet according to claim 1, further comprising:

a suction system adapted to suck air from the interior volume, an actuation system of the suction system adapted to trigger the suction system according to a position of the toilet seat.

3. The toilet according to claim 2, comprising a drain water tank controlled to alternately release or retain drain water, and wherein the suction system is controlled to suck air from the interior volume during the release of the drain water.

4. The toilet according to claim 3, wherein actuation of the water tank or the release of the waste water is adapted to trigger the actuation system of the suction system.

5. The toilet according to claim 4, comprising a drain water tank controlled to alternately release or retain drain water, and wherein the detection of the lowered position of the cover authorizes actuation of actuating the water tank or triggers the release of water contained in the water tank.

6. The toilet according to claim 1, further comprising a locking system of the cover in the lowered position, suitable for passing from an active configuration preventing the passage of the cover from the lowered position to a raised position to a passive configuration allowing the cover to pass from the lowered position to the raised position.

7. The toilet according to claim 6, wherein the passage of the locking system from the active configuration to the passive configuration is controlled by a depression sensor adapted to determine that the interior volume is under depression.

8. The toilet according to claim 1, further comprising a chemical decontamination system adapted to be ordered to implement a chemical decontamination of the interior volume.

9. The toilet according to claim 1, further comprising:

a locking system of the cover in the lowered position, suitable for passing from an active configuration preventing the passage of the cover from the lowered position to a raised position to a passive configuration allowing the cover to pass from the lowered position to a raised position, a chemical decontamination system adapted to be ordered to implement a chemical decontamination of the interior volume, wherein the locking system is prohibited from passing from the active configuration to the passive configuration when the UV radiation system and/or the chemical decontamination is functional.

10. The toilet according to claim 1, wherein the UV radiation system is controlled by a depression sensor adapted to determine that the interior volume is under depression.

11. The toilet according to claim 1, comprising a drain water tank controlled to alternately release or retain drain water.

* * * * *